United States Patent [19]

Dixon

[11] Patent Number: 4,962,567

[45] Date of Patent: Oct. 16, 1990

[54] BUTT HINGE ASSEMBLY

[76] Inventor: Wilbur Dixon, 44 S. Washington St., Beverly Hills, Fla. 32665

[21] Appl. No.: 379,178

[22] Filed: Jul. 13, 1989

[51] Int. Cl.[5] ..... E05C 17/00; E05D 11/00

[52] U.S. Cl. ..... 16/319; 16/342; 16/375; 16/85

[58] Field of Search ..... 16/226, 247, 250, 251, 16/277, 281, 292, 297, 321, 337, 375–377, 85, DIG. 17, 249, 296, 82, 303, 319, 342, DIG. 10, DIG. 43

[56] References Cited

U.S. PATENT DOCUMENTS

| | | | |
|---|---|---|---|
| 108,143 | 10/1870 | Huffer | 16/277 |
| 834,635 | 10/1906 | Olson | 16/277 |
| 1,860,198 | 5/1932 | Moore et al. | 16/377 |
| 1,931,271 | 10/1933 | Simmons | 16/375 |
| 2,047,461 | 7/1936 | Doyle | 16/250 |
| 2,584,404 | 2/1952 | Webb | 16/297 |
| 2,872,697 | 2/1959 | Hizsa, Jr. | 16/342 |

FOREIGN PATENT DOCUMENTS

| | | | |
|---|---|---|---|
| 1123031 | 9/1956 | France | 16/375 |
| 439913 | 10/1949 | Italy | 16/277 |

*Primary Examiner*—Richard K. Seidel
*Assistant Examiner*—Edward A. Brown
*Attorney, Agent, or Firm*—Merrill N. Johnson

[57] ABSTRACT

A butt hinge assembly for a door hinged to a casement which keeps the opened door from moving on its hinges due to air currents or other forces acting on the surfaces of the open door. The assembly consists of a conventional butt hinge having two cooperating hinge plates joined together by a hinge pin fitted into the aligned cylidrical knuckles formed on the adjoining ends of the two hinge plates and a flat tempered spring steel plate sized to fit against the hinge plate mounted on the casement and positioned between the casement and the hinge plate. The spring steel plate has a plurality of flat fingers or extensions each sized to press against one of the cylindrical knuckles of the hinge plate which is mounted on the door.

3 Claims, 1 Drawing Sheet

BUTT HINGE ASSEMBLY

BACKGROUND AND SUMMARY OF THE INVENTION

My invention lies in the field of butt hinges and especially butt hinges used in mounting doors onto casements.

A common problem with doors hingedly mounted onto casements is keeping a fully opened or partially opened door in its intended open position. Unless the door is fixed in its opened position by a doorjam or a wedge-shaped stop, air currents, wind gusts or other forces acting on the surfaces of the opened door will tend to "slam" the door shut or otherwise move the door from its desired position.

It is an object of my invention to provide a simple and effective mechanism to keep an opened door from moving due to air currents or similar forces acting on the open door.

It is a further object of my invention to provide a butt hinge with means to resist air currents which tend to move an open door from its intended position.

My invention is a butt hinge assembly which consists of a conventional butt hinge which includes two similar hinge plates joined together by a cylindrical hinge pin and a flat tempered spring steel plate. The hinge pin is fitted into the aligned cylindrical knuckles formed on the adjoining ends of the butt hinge's hinge plates. The spring steel plate is sized to fit against the hinge plate mounted on the casement and includes several flat extensions or fingers each of which is sized and positioned to press firmly against one of the cylindrical knuckles of the hinge plate mounted on the door. The friction between the spring steel fingers and the knuckles of the hinge plate will resist the force of air currents tending to "slam" the door or at least move it from its intended position.

DETAILED DESCRIPTION OF THE PREFERRED EMBODIMENT

Figure 1:
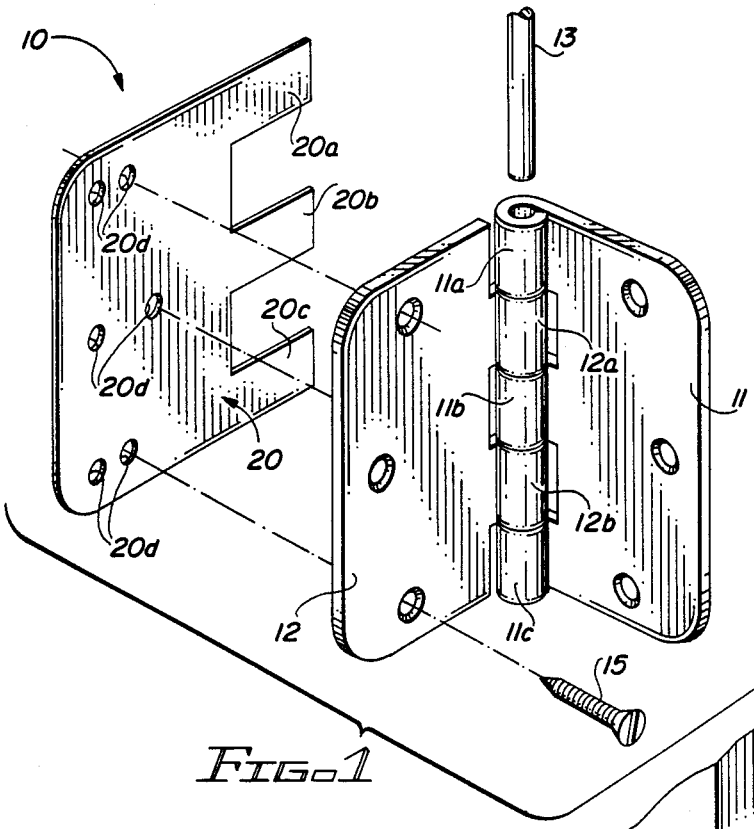
FIG. 1 is an exploded view of a preferred embodiment of my butt hinge assembly.

Referring to the drawings, FIG. 1 shows my butt hinge assembly 10 which includes a conventional brass butt hinge used for mounting a door onto its casement and a flat tempered spring steel plate 20 sized to fit against butt hinge 10.

The butt hinge includes two cooperating hinge plates 11 and 12 each having a plurality of holes for receiving screws such as screw 15 shown in FIG. 1. Hinge plates 11 and 12 are joined together by a hinge pin 13 which is fitted into a series of aligned cylindrical knuckles 11*a*, 12*a*, 11*b*, 12*b* and 11*c* which are formed on the adjoining ends of hinge plates 11 and 12 as best shown in FIG. 1.

Spring steel plate 20 is sized to fit snugly against hinge plate 12 and contains a plurality of cylindrical holes 20*d* including holes which align with the screw holes in hinge plate 12. The remaining holes 20*d* are positioned to align with butt hinges made by other manufacturers which have their screw holes in different positions.

Preferably plate 20 is stamped from flat spring steel stock 0.025 inches thick and then heat treated and annealed in order to temper the plate. Plate 20 includes three flat extensions or fingers 20*a*, 20*b* and 20*c* as best shown in FIG. 1 which are sized to rest firmly against knuckles 11*a*, 11*b* and 11*c* of hinge plate 11.

Figure 2:
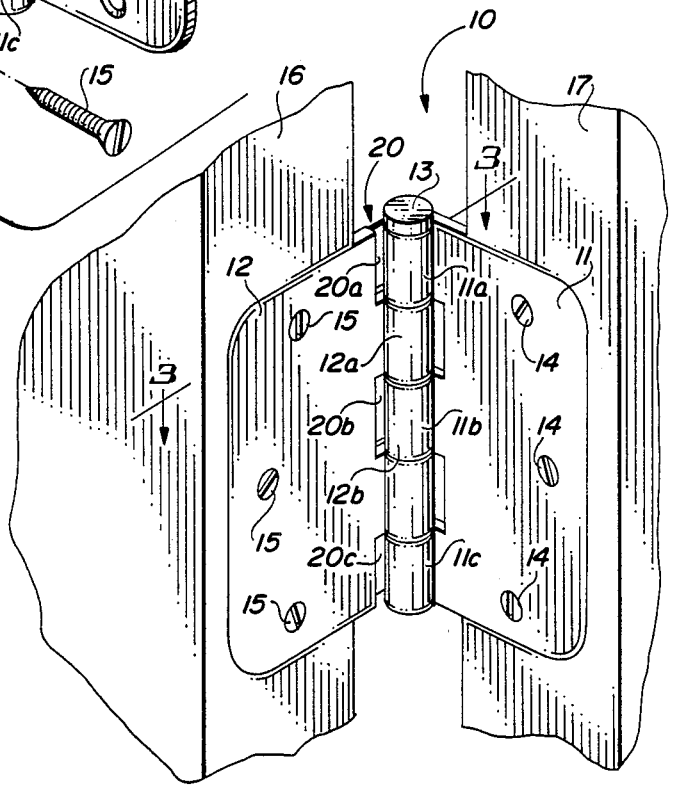
FIG. 2 is a perspective view of the hinge assembly shown in FIG. 1 mounted on a door and its casement with the door in an open position.
Figure 3:
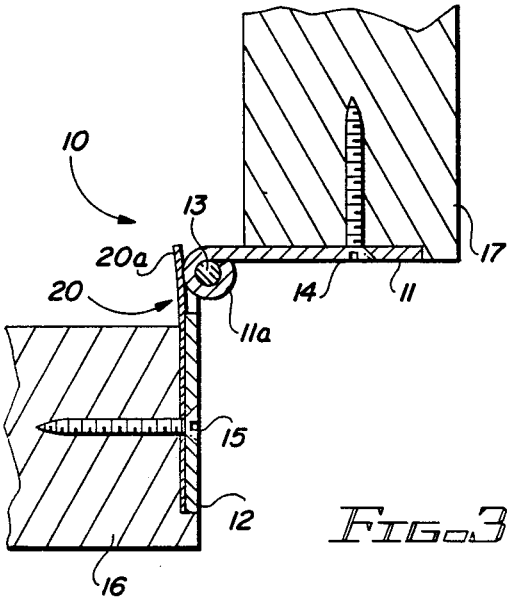
FIG. 3 is a cross-sectional plan view taken along line 3—3 of FIG. 2.

FIGS. 2 and 3 illustrate the installation of my butt hinge assembly 10 onto a door 17 and its casement 16. Spring steel plate 20 with hinge plate 12 on top of it are mounted on casement 16 by three screws 15 as best shown in FIG. 2. Then hinge plate 11 is mounted on door 17 with three screws 14 and the two hinge plates joined together by the insertion of hinge pin 13 into the cylindrical recesses within aligned knuckles 11*a*, 12*a*, 11*b*, 12*b* and 11*c*.

As can best be seen in FIG. 3, flat fingers 20*a*, 20*b* and 20*c* will press firmly against knuckles 11*a*, 11*b* and 11*c* respectively since the outer surface of each of these knuckles extends beyond the plane of the back surface of hinge plate 12, and the fingers 20*a*, 20*b* and 20*c* will continue to exert pressure on the hinge regardless of the exact position of the door. Thus my assembly creates a stablizing pressure on the door to remain in its present condition despite air currents or other forces acting on the surfaces of the door which tend to "slam" an open door.

Most residential and office doors are mounted onto the casement by three similar butt hinges. I have found it is not necessary to have three of my butt hinge assemblies in order to effectively put an end to aimlessly swinging open doors. The use of a single spring steel plate as shown in the drawings on one of the three butt hinges used to hang the door on the casement is all that is needed to prevent air currents from "slamming" the door.

While I have herein shown and described a preferred embodiment of my butt hinge assembly, those skilled in the art may suggest changes or modifications of a butt hinge assembly. The foregoing description should in no way limit the scope of my invention. The true scope of my invention is defined by the appended claims.

I claim:

1. A butt hinge assembly for a door hinged to a casement which assembly keeps the opened door from moving on its hinges due to air currents or other forces acting on the surfaces of the open door comprising a conventional butt hinge having two cooperating hinge plates respectively mounted on a casement and a door and joined together by a hinge pin fitted into a plurality of aligned cylindrical knuckles formed on the adjoining ends of the two hinge plates and a flat tempered spring steel plate sized to fit against the hinge plate mounted on the casement and positioned between the casement and the hinge plate, said spring steel plate having a plurality of flat fingers, each finger sized to press firmly against one of the cylindrical knuckles of the hinge plate which is mounted on the door.

2. A butt hinge assembly as set forth in claim 1 in which there are three spaced apart knuckles on the hinge plate mounted on the door and the spring steel plate has three spaced apart fingers.

3. A butt hinge assembly as set forth in claim 1 in which the thickness of the spring steel plate is between 0.02 and 0.03 inches.

* * * * *